US006190144B1

(12) United States Patent
Balma

(10) Patent No.: US 6,190,144 B1
(45) Date of Patent: Feb. 20, 2001

(54) COMPRESSOR HAVING EASILY INSTALLED CHECK VALVES

(75) Inventor: Antonio Balma, Fiano (IT)

(73) Assignee: Abac Aria Compressa S.p.A., Robassomero (IT)

( * ) Notice: Under 35 U.S.C. 154(b), the term of this patent shall be extended for 0 days.

(21) Appl. No.: 09/332,372

(22) Filed: Jun. 14, 1999

(30) Foreign Application Priority Data

Jun. 19, 1998 (IT) ..... T098U0116

(51) Int. Cl.[7] ..... F04B 39/10; F16K 15/00; F16K 25/00

(52) U.S. Cl. ..... 417/571; 137/512; 137/454.4

(58) Field of Search ..... 417/571; 137/512, 137/543.19, 540, 454.4, 454.5

(56) References Cited

U.S. PATENT DOCUMENTS 2,800,142 * 7/1957 Champion ..... 137/543.19
3,250,225 * 5/1966 Taplin ..... 417/571
3,354,830 * 11/1967 Mortara ..... 137/454.4
3,679,333 * 7/1972 Zoppi ..... 417/571
5,520,522 * 5/1996 Rathore et al. ..... 417/571
5,839,468 * 11/1998 Allred ..... 137/454.4

FOREIGN PATENT DOCUMENTS

2107830 * 5/1983 (GB) .

* cited by examiner

*Primary Examiner*—Charles G. Freay
*Assistant Examiner*—Michael K. Gray
(74) *Attorney, Agent, or Firm*—Schlesinger, Arkwright & Garvey LLP

(57) ABSTRACT

A compressor having at least one cylinder in which is defined a compression chamber defined at the bottom by a piston movable along the cylinder, and at the top by a wall having a suction opening and an exhaust opening, each of which is connected to a respective conduit by a respective valve having a channel in which a sealing member slides, in opposition to a spring, from a closed position, in which the compression chamber is cut off from the respective conduit, to an open position, in which the compression chamber communicates with the respective conduit.

7 Claims, 3 Drawing Sheets

COMPRESSOR HAVING EASILY INSTALLED CHECK VALVES

The present invention relates to a compressor, preferably, but not exclusively, a low-power compressor normally suitable for domestic, as opposed to professional, use.

BACKGROUND OF THE INVENTION

Known compressors normally comprise at least one cylinder, in which is defined a compression chamber in turn defined, at the bottom, by a piston movable along the cylinder, and, at the top, by a wall having a suction opening and an exhaust opening, each of which is connected to a respective conduit by a respective valve.

The valves of known low-power compressors are normally blade types, i.e. each defined by a respective elastic metal blade contacting a flat seat formed in a metal valve-holder plate about a respective conduit to normally close the conduit, and which is deformed elastically by the suction or compression pressure to open the conduit.

Blade valves have several drawbacks, and in particular generate a high noise level on account of the blade metal continually striking the metal of the valve-holder plate.

SUMMARY OF THE INVENTION

It is an object of the present invention to provide a compressor designed to eliminate the aforementioned drawback, and which is also straightforward and cheap to produce.

According to the present invention, there is provided a compressor comprising at least one cylinder having an end wall in turn having a suction opening and an exhaust opening; a piston movable along said cylinder; a suction conduit and an exhaust conduit connected respectively to said suction opening and said exhaust opening; a compression chamber defined in said cylinder, and which is defined at the bottom by said piston and at the top by said end wall; and a suction valve and an exhaust valve for respectively controlling said suction conduit and said exhaust conduit; characterized in that each said valve comprises a tubular body housed in sealed manner inside the respective said conduit; a valve seat formed in said tubular body; a sealing member sliding along said tubular body to and from a contact and closed position contacting in sealed manner said valve seat and closing said tubular body; and elastic means for normally maintaining said sealing member in said contact and closed position with a force of a predetermined value.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
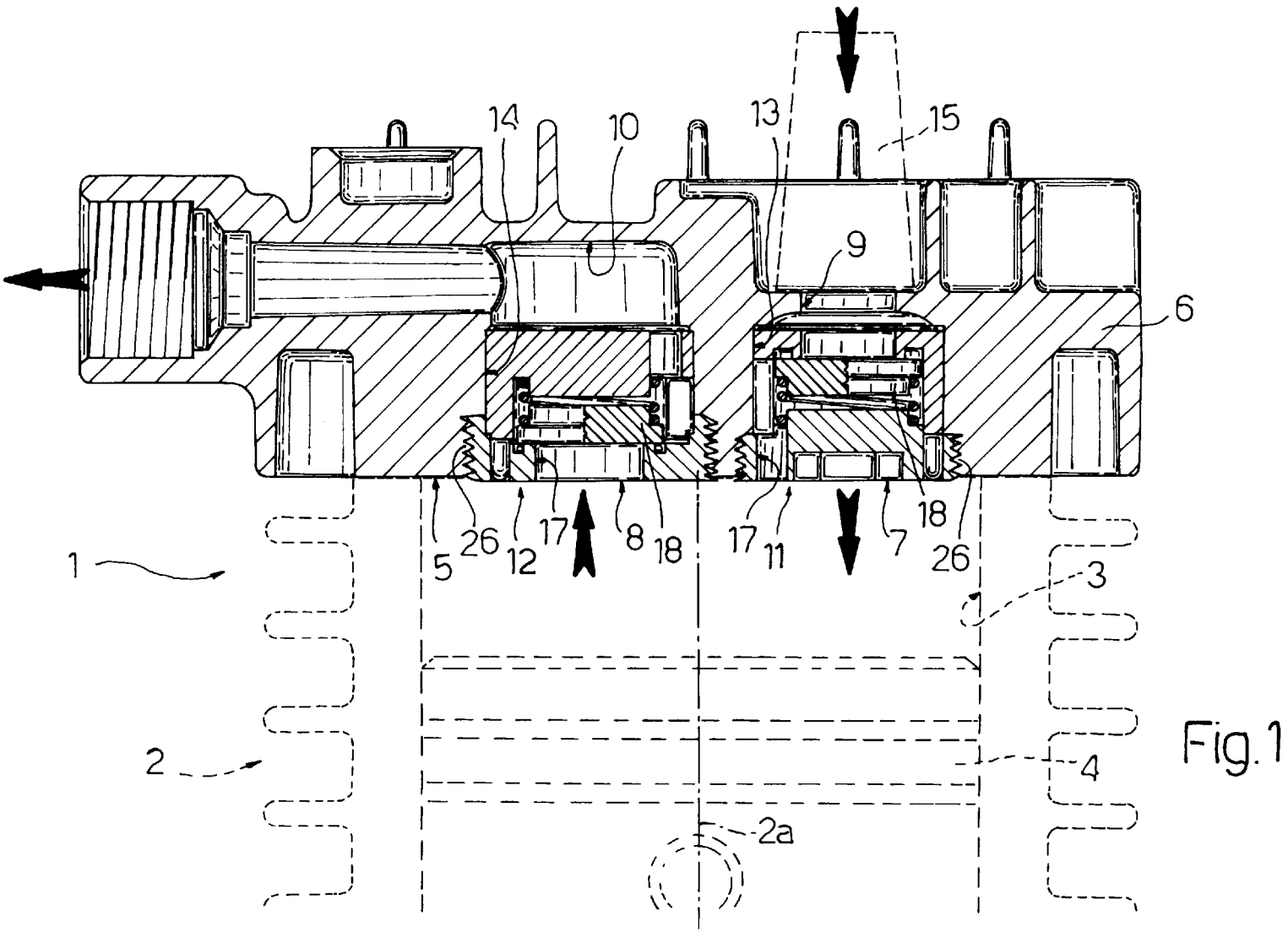
FIG. 1 shows a schematic section of a preferred embodiment of the compressor according to the present invention.

Number 1 in FIG. 1 indicates as a whole a compressor comprising a cylinder 2 having a longitudinal axis 2*a* and a compression chamber 3, which is defined at the bottom by a piston 4 movable back and forth inside cylinder 2 and along axis 2*a,* and at the top by an inner surface 5 of a head 6 perpendicular to axis 2*a*.

Surface 5 comprises a suction opening 7 and an exhaust opening 8, which respectively define the inner ends of a suction conduit 9 and an exhaust conduit 10 controlled respectively by a suction valve 11 and an exhaust valve 12.

Conduits 9 and 10 have respective cavities 13 and 14, which communicate directly with chamber 3 and respectively house suction valve 11 and exhaust valve 12 in sealed manner.

Suction conduit 9 extends, parallel to axis 2*a,* through head 6 and is connected to an air intake filter 15 at the end communicating with the outside atmosphere; and exhaust conduit 10 comprises a substantially L-shaped initial portion formed through head 6. More specifically, conduit 10 comprises a first portion defined by cavity 14 and extending parallel to axis 2*a;* and a further portion extending perpendicular to axis 2*a,* and which is connectable, at the end opposite the end connected to cavity 14, to a known compressed air tank (not shown).

Figure 2:
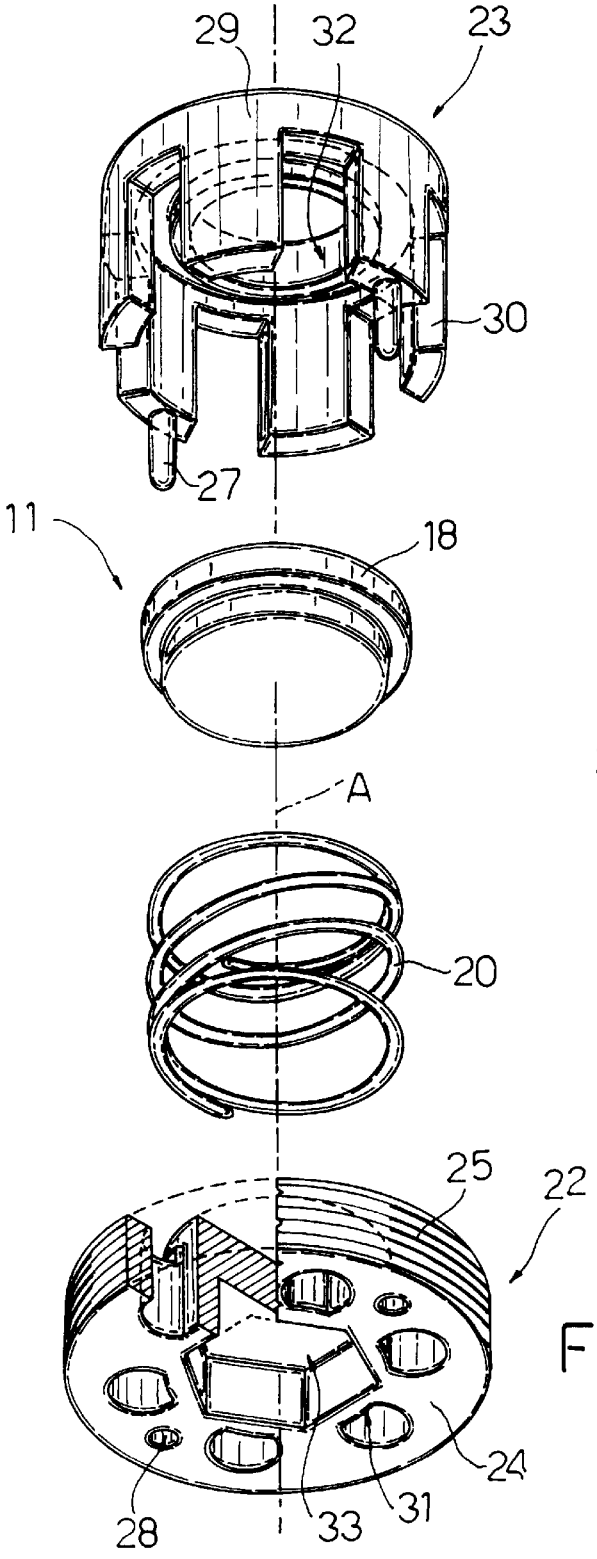
FIGS. 2 and 3 respectively show an exploded view in perspective and a section of a first detail in FIG. 1.
Figure 3:
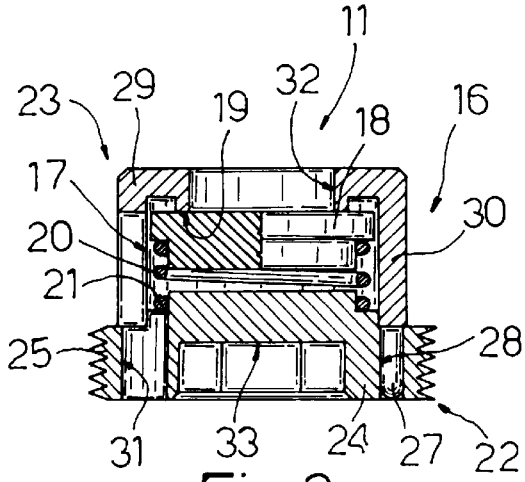
Figure 4:
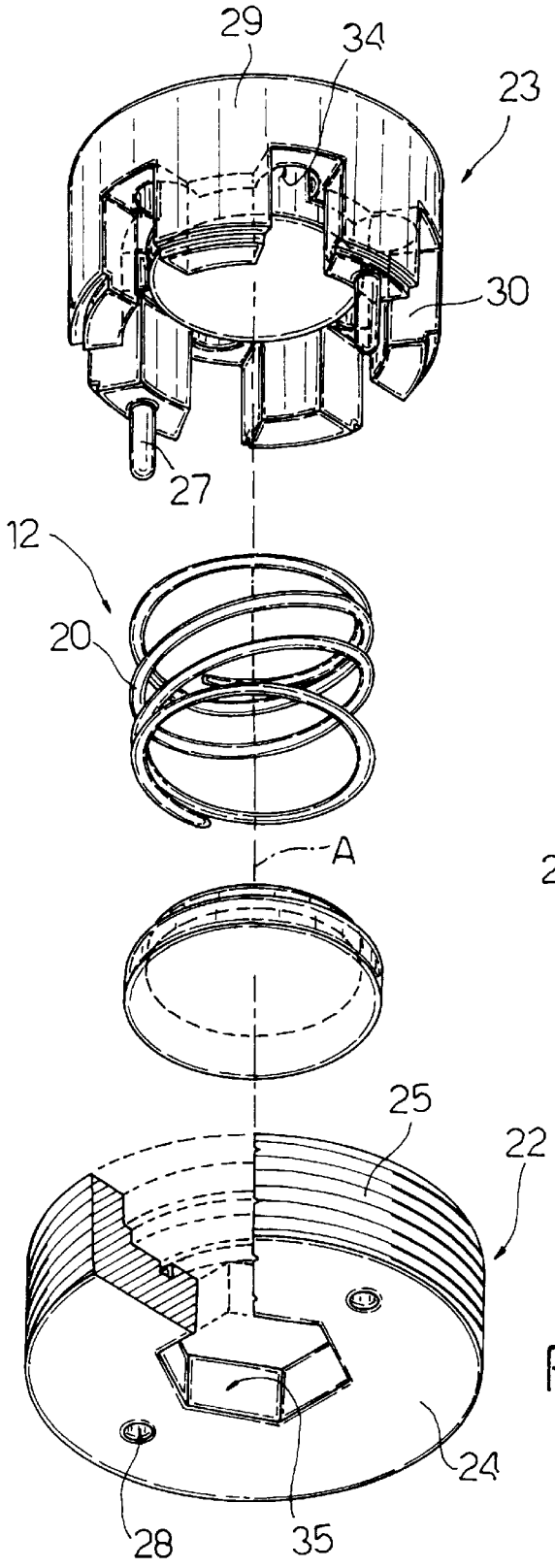
FIGS. 4 and 5 respectively show an exploded view in perspective and a section of a second detail in FIG. 1.
Figure 5:
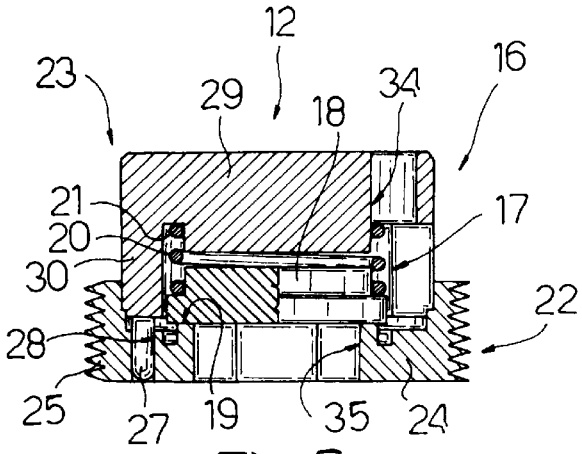

As shown more clearly in FIGS. 2 and 3 (relative to suction valve 11) and FIGS. 4 and 5 (relative to exhaust valve 12), each valve 11, 12 has an axis A parallel to axis 2*a,* and comprises a tubular body 16 in which is defined a channel 17 communicating at one end with respective conduit 9, 10 and at the other end with chamber 3.

Each valve 11, 12 also comprises a sealing member 18 which slides along channel 17 to and from a contact position contacting in sealed manner a valve seat 19 formed in tubular body 16. The contact position in which sealing member 18 contacts valve seat 19 corresponds to a closed position of respective valve 11, 12 (shown in FIGS. 1, 3 and 5) in which chamber 3 is cut off from conduit 9, 10. Conversely, a noncontacting position in which sealing member 18 is detached from valve seat 19 corresponds to an open position of respective valve 11, 12, in which compression chamber 3 communicates with respective conduit 9, 10.

Sealing member 18 slides along channel 17 in opposition to a spring 20 housed coaxially inside channel 17 and which is compressed between sealing member 18 and a stop member 21, carried by tubular body 16, to keep sealing member 18 in said closed position with a force of predetermined value.

As shown more clearly in FIGS. 2 and 4, tubular body 16 is defined by the union of a bottom portion 22 and a top portion 23 independent of each other. Bottom portion 22 is defined by a substantially cylindrical drilled plate 24 having a threaded outer peripheral portion 25 for engaging a corresponding thread 26 formed on the inner surface of respective cavity 13, 14.

Top portion 23 of tubular body 16 has a pair of axial locating pins 27 for engaging corresponding holes 28 formed in bottom portion 22 to ensure portions 22 and 23 are coaxial with each other.

Top portion 23 of tubular body 16 comprises a drilled plate 29; and a number of peripheral appendixes 30 equally spaced about respective axis A and extending axially from drilled plate 29 towards the corresponding bottom portion 22.

As shown in FIG. 3, valve seat 19 of suction valve 11 is formed in plate 29 and therefore in the top portion of respective channel 17; and stop member 21 of suction valve 11 is defined by plate 24. Consequently, sealing member 18 of suction valve 11 is moved into said open position, in opposition to respective spring 20, by a positive pressure difference between suction conduit 9 and compression chamber 3, i.e. when the air pressure in suction conduit 9 is greater than the air pressure in compression chamber 3.

As shown in FIG. 5, valve seat 19 of exhaust valve 12 is formed in plate 24 and therefore in the bottom portion of respective channel 17; and stop member 21 of exhaust valve 12 is formed on plate 29. Consequently, sealing member 18 of exhaust valve 12 is moved into said open position, in opposition to respective spring 20, by a negative pressure difference between exhaust conduit 10 and compression chamber 3, i.e. when the air pressure in exhaust conduit 10 is lower than the air pressure in compression chamber 3.

As shown in FIG. 2, channel 17 of suction valve 11 opens out towards compression chamber 3 through a number of holes 31 formed through plate 24 and equally spaced about axis A, and opens out towards suction conduit 9 through a single hole 32 formed centrally through plate 29. Bottom portion 22 of suction valve 11 also comprises a hexagonal socket 33 which is engaged by an Allen wrench to screw plate 24 to head 6.

As shown in FIG. 4, channel 17 of exhaust valve 12 opens out towards exhaust conduit 10 through a number of holes 34 formed through plate 29 and equally spaced about axis A, and opens out towards compression chamber 3 through a single hole 35 formed centrally through plate 24 and having a hexagonal first portion which is engaged by an Allen wrench to screw plate 24 to head 6.

In actual use, piston 4 is moved along cylinder 2 by a known external motor (not shown) to alternately perform a suction stroke, in which piston 4 slides down to increase the volume of compression chamber 3, and a subsequent compression stroke in which piston 4 slides up to reduce the volume of compression chamber 3.

Operation of compressor 1 will now be described as of the start of a suction stroke, in which valves 11 and 12 are both in said closed position.

During the suction stroke, piston 4 gradually increases the volume of, and therefore reduces the air pressure in, compression chamber 3; and the difference between the atmospheric air pressure in suction conduit 9 and the air pressure in compression chamber 3 tends to move sealing member 18 of suction valve 11 into said open position in opposition to respective spring 20.

When said difference in pressure is sufficient to overcome the force of spring 20, sealing member 18 of suction valve 11 moves into the open position, and ambient air is sucked into compression chamber 3 along suction conduit 9.

At the end of the suction stroke, the downward travel of piston 4 is arrested, so that the air pressure in compression chamber 3 tends to equal the air pressure in suction conduit 9, the force acting on sealing member 18 of suction valve 11 as a result of said difference in pressure is gradually reduced, and member 18 is moved back into the closed position by spring 20.

During the compression stroke, piston 4 gradually reduces the volume of, and therefore increases the air pressure in, compression chamber 3; and the difference between the air pressure in exhaust conduit 10 and the air pressure in compression chamber 3 tends to move sealing member 18 of exhaust valve 12 into said open position in opposition to respective spring 20.

When said difference in pressure is sufficient to overcome the force of spring 20, sealing member 18 of exhaust valve 12 moves into the open position, and the air in compression chamber 3 is exhausted into exhaust conduit 10.

At the end of the compression stroke, the upward travel of piston 4 is arrested, so that the air pressure in compression chamber 3 tends to equal the air pressure in exhaust conduit 10, the force acting on sealing member 18 of exhaust valve 12 as a result of said difference in pressure is gradually reduced, and member 18 is moved back into the closed position by spring 20.

The above strokes are then repeated cyclically.

In a first embodiment, tubular body 16 of valve 11, 12 is made of metal, in particular steel, and sealing member 18 is made of rigid rubber.

In a further embodiment, tubular body 16 of valve 11, 12 is made of plastic material; sealing member 18 is made of rigid rubber; and portions 22 and 23 of each tubular body 16 are joined inseparably by bonding or ultrasonic welding.

As compared with a corresponding compressor employing blade valves, tests have shown compressor 1 as described above to provide for over a 5 db reduction in service noise (measured at a distance of 1 meter); which reduction is achieved using valves 11 and 12, in which impact between moving and fixed parts occurs between a rubber part (sealing member 18) and a metal part (tubular body 16).

What is claimed is:

1. A compressor comprising:

a) at least one cylinder having a head including a suction opening and an exhaust opening;

b) a piston movable along said cylinder;

c) a suction conduit and an exhaust conduit connected, respectively, to said suction opening and said exhaust opening;

d) a compression chamber defined in said cylinder, and further defined by said piston and by said head;

e) a suction valve and an exhaust valve to respectively control said suction conduit and said exhaust conduit;

f) each of said valves comprising a tubular body housed in a sealed manner inside the respective said conduit;

g) a valve seat formed in said tubular body;

h) a sealing member sliding along said tubular body to and from a contact and closed position contacting in sealed manner said valve seat and closing said tubular body;

i) a spring to normally maintain said sealing member in said contact and closed position with a force of a predetermined value, said spring being compressed inside said tubular body between said sealing member and a stop carried by said tubular body; and j) said tubular body comprising first and second portions independent of one another wherein said stop is carried by one and said valve seat by the other of said first and second portions of said tubular body.

2. A compressor as claimed in claim 1, wherein:

a) said head defines an end wall;

b) each of said conduits being formed through said head and comprising a cavity housing the respective said tubular body; and c) said first portion of said tubular body comprising a threaded portion engaging a corresponding thread formed on a surface of said cavity.

3. A compressor as claimed in claim 1, wherein:

a) said first portion comprises a substantially cylindrical drilled plate; and b) said threaded portion being an outer peripheral portion of said plate.

4. A compressor as claimed in claim 3, wherein:

a) said second portion comprises a further drilled plate; and b) a number of peripheral appendixes extend axially from said further drilled plate towards said first portion.

5. A compressor as claimed in claim 1, wherein said sealing member is made of rubber.

6. A compressor as claimed in claim 1, wherein said tubular body is made of metal material.

7. A compressor as claimed in claim 1, wherein said tubular body is made of plastic material.

* * * * *